US007000357B1

(12) United States Patent
Stearns et al.

(10) Patent No.: US 7,000,357 B1
(45) Date of Patent: Feb. 21, 2006

(54) ANTENNA MAST TRANSPORT AND DEPLOYMENT SYSTEM

(75) Inventors: Craig Kimbal Stearns, Bradford, MA (US); Raymond Arthur Roberge, Stow, MA (US); Theodore Alden Richardson, Kittery, ME (US)

(73) Assignee: Raytheon Company, Waltham, MA (US)

( * ) Notice: Subject to any disclaimer, the term of this patent is extended or adjusted under 35 U.S.C. 154(b) by 120 days.

(21) Appl. No.: 10/426,817

(22) Filed: Apr. 30, 2003

(51) Int. Cl.
*E04H 12/00* (2006.01)

(52) U.S. Cl. ..... 52/110; 52/111; 52/118; 52/40

(58) Field of Classification Search ..... 52/111, 52/118, 40, 110; 343/901, 713, 715, 711; 280/1
See application file for complete search history.

(56) References Cited

U.S. PATENT DOCUMENTS

| | | | | |
|---|---|---|---|---|
| 4,231,200 | A | 11/1980 | Henderson | |
| 5,102,375 | A | 4/1992 | Featherstone | |
| 5,168,679 | A | 12/1992 | Featherstone | |
| 5,611,177 | A * | 3/1997 | Herbstritt | 52/111 |
| 5,786,854 | A | 7/1998 | Slade et al. | |
| 6,104,910 | A | 8/2000 | Koths | |
| 6,260,310 | B1 | 7/2001 | Price et al. | |
| RE37,559 | E | 2/2002 | Marue et al. | |
| 6,767,115 | B1 * | 7/2004 | Blackwelder | 362/385 |

OTHER PUBLICATIONS

Engineering Services Memorandum; Subject: Lightweight Antenna Mast Group: U.S. Government Contract No. DAAH-01-99-C-0028; Submitted May 15, 2002 by Raytheon Electronic Systems.

"Light Angenna Mast Group (LAMG);" Raytheon Integrated Defense Systems; Brochure, AUSA Show, Oct. 2002.

"WIBE HMMWV Based Antenna Mast System;" Raytheon Electronic Systems; Photographs of AB WIBE System; Slides 20 and 21; AB WIBE, Sweden; Apr. 2000.

* cited by examiner

*Primary Examiner*—Milton Nelson, Jr.
(74) *Attorney, Agent, or Firm*—Daly, Crowley, Mofford & Durkee, LLP

(57) ABSTRACT

A light antenna mast group (LAMG) provides antenna masts coupled to a vehicle cap structure which is disposed on the top of a light truck, which in one embodiment can be a high mobility multipurpose wheeled vehicle (HMMWV). The vehicle cap structure includes antenna mast deployment mechanisms, hinged rotator assemblies, an antenna storage system, and a plurality of spring loaded guide wire spools, all adapted to make deployment of the antenna masts rapid and simple.

34 Claims, 10 Drawing Sheets

ANTENNA MAST TRANSPORT AND DEPLOYMENT SYSTEM

CROSS REFERENCE TO RELATED APPLICATIONS

Not Applicable.

STATEMENT REGARDING FEDERALLY SPONSORED RESEARCH

Not Applicable.

FIELD OF THE INVENTION

This invention relates generally to antenna systems and more particularly to an antenna system mounted to and deployed from a truck.

BACKGROUND OF THE INVENTION

The Patriot Missile System, used by the United States military, includes a variety of subsystems. One such subsystem is the "antenna mast group" (AMG). The AMG includes a truck, e.g., a 5-ton, Model M-942 truck, that transports two antenna masts and associated equipment. The truck also provides a platform from which the two antenna masts are deployed to a vertical orientation. The two antenna masts, when deployed to the vertical orientation, each support two antennas used for communications. Each of the two antennas is coupled to a respective rotator, adapted to independently rotate each of the two antennas to point to a desired direction.

The truck used as part of the conventional AMG is a relatively large truck, having a gross vehicle weight (GWV) greater than fifteen thousand pounds, not including the antenna masts and antenna mast deployment mechanisms. The conventional AMG, due to its large size and heavy weight, particularly the large size and heavy weight of the truck, must be transported to a battlefield by a large aircraft, for example a C5 aircraft. The C5 aircraft can only carry one conventional AMG. The requirement to transport the AMG with a large aircraft, which can only carry one AMG, limits the ability to rapidly deploy multiple Patriot Missile Systems, and therefore multiple AMGs, to remote battlefields.

Once transported to a battlefield, the conventional AMG requires approximately 30 minutes to deploy to an operational configuration. Deployment includes a variety of steps, including, but not limited to, attaching electronic cables associated with the antennas, and deploying the two antenna masts to a vertical orientation at a height of up to eighty-four feet.

Another antenna mast system made by AB WIBE, a company located in Sweden, is referred to herein as the WIBE system. The WIBE system includes two relatively small antenna masts mounted on the top of a modified high mobility multipurpose wheeled vehicle (HMMWV). The HMMWV will be recognized to be a military vehicle used throughout the world, including the United States, primarily as a platform with which to carry troops and light supplies. The HMMWV curb weight is approximately 6,400 pounds, not including payload & crew.

The HMMWV used as part of the WIBE system has a structural strength capable of carrying two relatively small antenna masts. The longer of the two antenna masts can be deployed to an operational height of less than eighty-four feet, and can carry a head load of approximately ninety pounds in winds up to sixty-two miles per hour. During transport, the two antenna masts are horizontally oriented and positioned on the top of the HMMWV so as to be parallel to the central axis of the HMMWV. During deployment of the two antenna masts, each of the two antenna masts is first rotated to a vertical orientation and then extended to operational height.

The WIBE system has no geared mechanisms with mechanical advantage to assist with deployment of the antenna masts from the horizontal orientation to the vertical orientation. Instead the deployment of each of the two antenna masts from horizontal to vertical is performed manually.

Furthermore, the WIBE system is not adapted to transport and deploy the larger and heavier antenna masts required by the Patriot Missile System. The antenna masts required by the Patriot Missile System must deploy vertically up to eighty four feet and must be capable of carrying heavy loads, for example, two hundred fifty pounds per antenna mast, in high winds, for example, up to ninety-six mile per hour gusts.

It would, therefore, be desirable to overcome the aforesaid and other disadvantages.

SUMMARY OF THE INVENTION

The present invention provides a Light Antenna Mast Group (LAMG) having at least one antenna mast coupled to and deployed from a truck small enough to be transported on a medium size transport aircraft, for example a C130 aircraft. With this arrangement, a lightweight antenna system is provided that can be transported throughout the world relatively quickly and efficiently. While the invention is primarily shown and described to include two antenna masts meeting the height and strength requirements of an antenna mast used in an antenna mast group (AMG) subsystem used as part of the Patriot Missile System, it should be appreciated that the invention is applicable to antenna systems in general in which it is desirable to have relatively light, high strength antenna masts. Also, while the invention is shown in conjunction with communication systems, it is understood that the invention is applicable to any system that requires antennas, for example a radar system, surveillance camera systems, and infrared (I/R) camera (night vision) systems.

In accordance with the present invention, an antenna apparatus includes a support frame for coupling to the rear of a vehicle isolated frame and capable of providing support for a vehicle cap structure including at least one antenna mast. The vehicle cap structure also includes a first antenna mast deployment mechanism coupled to the antenna mast and adapted to linearly move the antenna mast in a direction substantially parallel to a major axis of the vehicle, and a second antenna mast deployment mechanism coupled to the antenna mast and adapted to rotate the antenna mast to a substantially vertical orientation. In one particular embodiment, the antenna apparatus is adapted for attachment to a high mobility multipurpose wheeled vehicle (HMMWV). In an exemplary embodiment, the antenna mast is capable of carrying a two hundred fifty pound head load at an extended vertical height of eighty-four feet in winds of up to ninety-six miles per hour gusts.

With this particular arrangement, a relatively small and lightweight vehicle cap structure is provided that can be coupled to a relatively small and lightweight vehicle. With the first and second antenna mast deployment mechanisms, the antenna mast can be rapidly deployed.

In accordance with another aspect of the present invention, a vehicle includes the vehicle cap structure and the support frame described above. In an exemplary embodiment, the vehicle is a high mobility multipurpose wheeled vehicle (HMMWV), capable of supporting the antenna mast when the antenna mast carries a two hundred fifty pound head load at an extended vertical height of eighty-four feet in winds of up to ninety-six miles per hour gusts.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Figure 1:
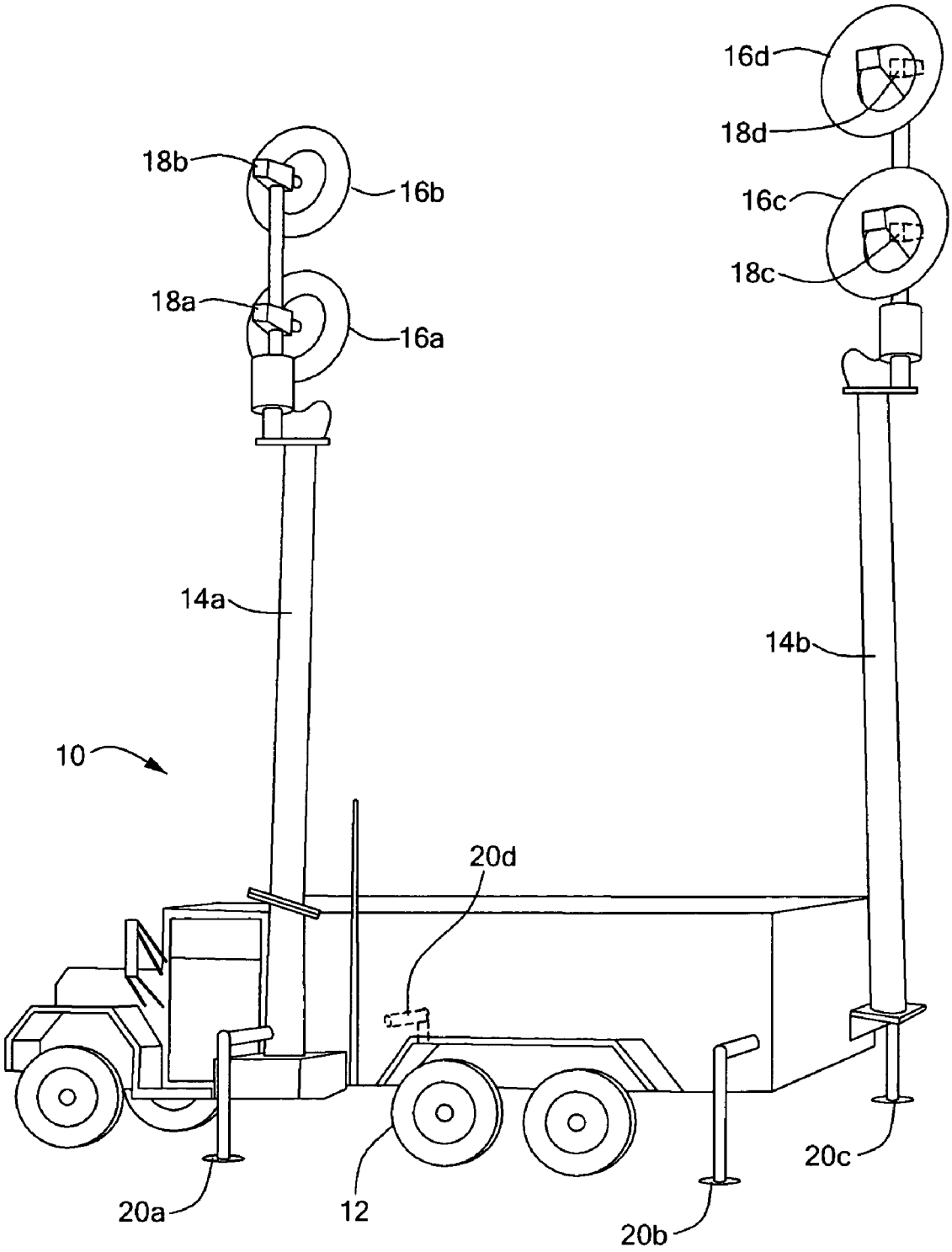
FIG. 1 PRIOR ART
FIG. 1 is a pictorial showing a prior art antenna mast group (AMG) used as part of the Patriot Missile System.

Referring now to FIG. 1, a prior art antenna mast group (AMG) 10 used as part of the Patriot Missile System includes an M-942 truck 12. The AMG 10 is shown in a deployed configuration.

Two antenna masts 14*a*, 14*b*, each having telescoping tubes, are carried by and deployed from the truck 12. Two antennas 16*a*–16*d* are mounted at or near the top of each respective antenna mast 14*a*, 14*b*. Each of the antennas 16*a*–16*d* is coupled to a respective rotator 18*a*–18*d*, which allows independent rotational control of the antennas 16*a*–16*d* so that each of the antennas 16*a*–16*d* can be independently pointed to a desired direction. The truck 12 includes four outriggers 20*a*–20*d*, used to stabilize the truck 12 and antenna masts 14*a*, 14*b*.

Each of the antenna masts 14*a*, 14*b* is shown in a vertical position corresponding to a deployed configuration. However, each of the two antenna masts 14*a*, 14*b* is in a horizontal position during transport. During deployment, each of the antenna masts 14*a*, 14*b* is rotated to a vertical position by a hydraulic system and extended to operational height by a pneumatic system.

During transport, the antennas 16*a*–16*d* and associated rotators 18*a*–18*d* are stowed on the truck 12 and are not coupled to the antenna masts 14*a*, 14*b*. Rather, as part of the deployment of the antenna masts 14*a*, 14*b*, the rotators 18*a*–18*d* and the associated antennas 16*a*–16*d* are attached to the antenna masts 14*a*, 14*b* and adjusted for elevation. The adjustment requires time that tends to extend the overall deployment time of the AMG 10.

During deployment, following attachment of the rotators 18*a*–18*d* and the antennas 16*a*–16*d*, the antenna masts 14*a*, 14*b* are rotated from a horizontal position to a vertical position by a hydraulic system (not shown) aboard the truck 12. Also during deployment, as described above, each of the antenna masts 14*a*, 14*b* are raised to operational height by a pneumatic system.

Each of the antenna masts 14*a*, 14*b* can be independently deployed to heights as high as approximately eighty-four feet. When so deployed, the antennas 16*a*–16*d* can be higher than eighty-four feet. The operational height of the deployment is determined by communication requirements. When a communication link can be established with the antennas 18*a*–18*d* at a lower height, there is no need to raise the antenna masts 14*a*, 14*b* further.

As is known, when the antenna masts are raised to high elevations, the AMG 10 becomes less stable. The AMG is specified to operate in winds as high as ninety-six miles per hour (gusts) with the antenna masts 14*a*, 14*b* each deployed to eighty four feet. Thus, the outriggers 20*a*–20*d* are used to provide added stability.

The AMG 10 weighs more thirty-five thousand pounds, which makes it difficult to transport the AMG with an aircraft. Only one AMG can be transported on a large aircraft.

Figure 2:
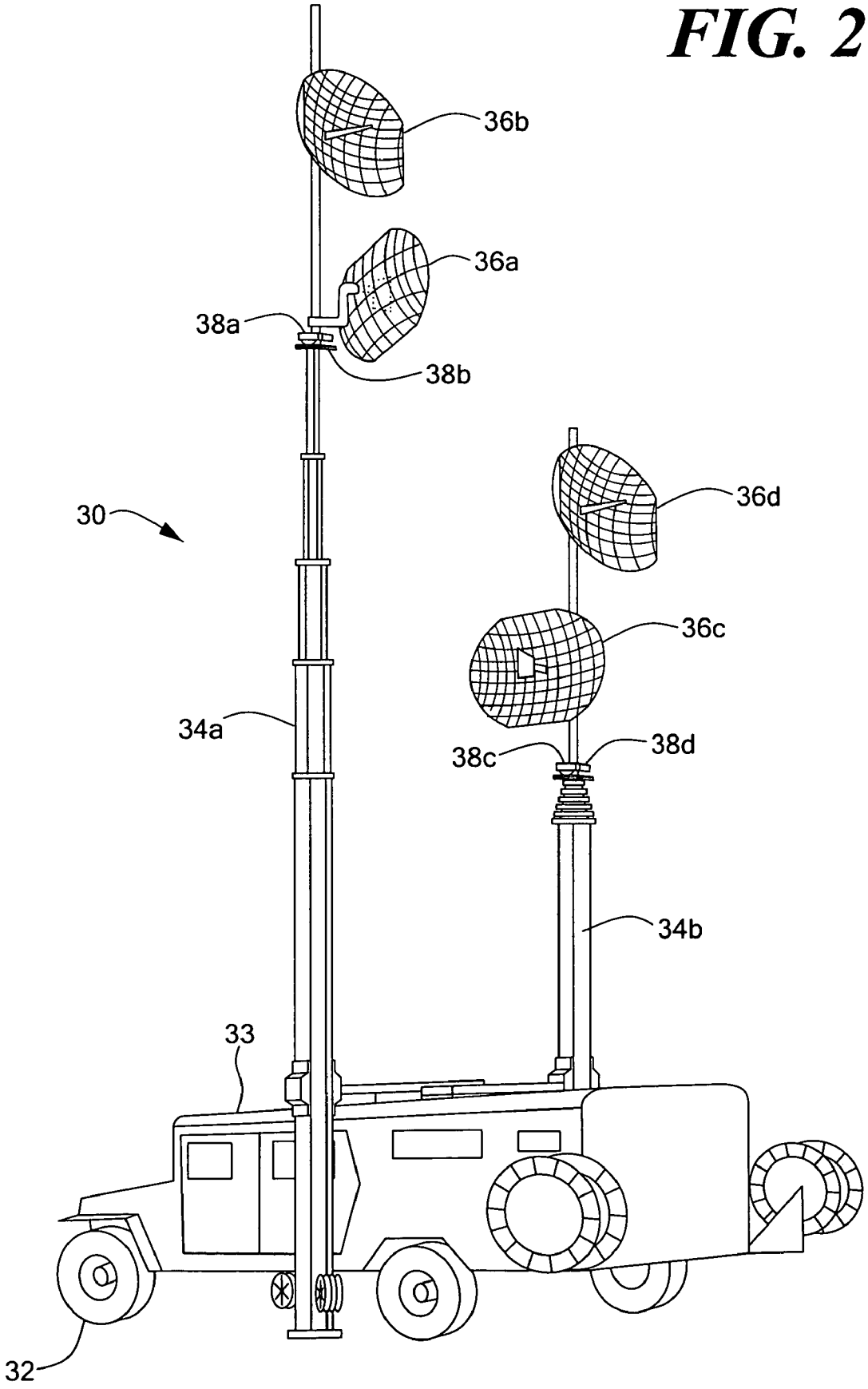
FIG. 2 is a pictorial of the light antenna mast group (LAMG) in accordance with the present invention, shown in a deployed configuration.

Referring now to FIG. 2, a light antenna mast group (LAMG) 30 in accordance with the present invention includes an antenna cap structure 33 having two antenna masts 34*a*, 34*b*, each with telescoping tubes. Two antennas 36*a*–36*d* are mounted at or near the top of each respective antenna mast 34*a*, 34*b*. Each of the antennas 36*a*–36*d* is coupled to a respective rotator 38*a*–38*d*, which allows independent rotational control of the antennas 36*a*–36*d* so that each of the antennas 36*a*–36*d* can be independently pointed to a desired direction. The vehicle cap structure 33 can be coupled to a vehicle 32, here shown as a high mobility multipurpose wheeled vehicle (HMMWV) 32. While shown and described to have telescoping tubes, it is understood that the antenna masts can have a variety of structures for facilitating raising and lowering of the antenna masts.

Each of the antenna masts 34*a*, 34*b* is shown in a vertical position corresponding to a deployed configuration. However, each of the two antenna masts 34*a*, 34*b* is in a horizontal position during transport. During deployment, each of the antenna masts 34*a*, 34*b* is moved horizontally by a first antenna mast deployment mechanism (not shown) and rotated to a vertical position by a second antenna mast deployment mechanism (not shown). The first and the second antenna mast deployment mechanisms are further described in conjunction with FIG. 5. The first and second antenna mast deployment mechanisms provide a user with a mechanical advantage.

In one embodiment, each of the two antenna masts 34*a*, 34*b* can be independently deployed to heights as high as eighty-four feet. When so deployed, the height of the antennas 36*a*–36*d* can be more than eighty-four feet. For example, the height of the center of the highest antennas 36*b*, 36*d* can be approximately 88 feet. It is understood that the height of the deployment is determined by communication requirements. When a communication link can be established with the antennas 36*a*–36*d* at a lower height, there is no need to raise the antenna masts 34*a*, 34*b* further.

When the antenna masts 34*a*, 34*b* are raised to higher elevations, the LAMG 30 becomes less stable. In one embodiment, the LAMG 30 can operate in winds as high as ninety-six miles per hour with the antenna masts 34*a*, 34*b* each deployed to eighty-four feet, and with each antenna mast carrying a head load of two hundred fifty pounds. Guide wires (not shown) are used to stabilize each of the two antenna masts. The guide wires are further described in conjunction with FIGS. 3 and 8.

In other embodiments, the antenna masts are capable of deployment to heights greater than or less than eighty-four feet. For example, in an exemplary embodiment, the antenna masts are capable of deployment to a height greater than seventy-five feet. In other embodiments, the antenna masts are capable of operation in maximum winds of more than or less than ninety-six miles per hour, each antenna mast carrying a head load of more than or less than two hundred fifty pounds. For example, in one particular embodiment, each of the antenna masts is capable of carrying a head load of at least two-hundred pounds when deployed to a height of at least seventy-five feet in winds of at least ninety miles per hour.

While the invention is primarily shown and described in conjunction with the Patriot Missile System, it is understood that the invention is applicable to mobile antenna systems in general, including, but not limited to, communication and radar antenna systems.

Figure 3:
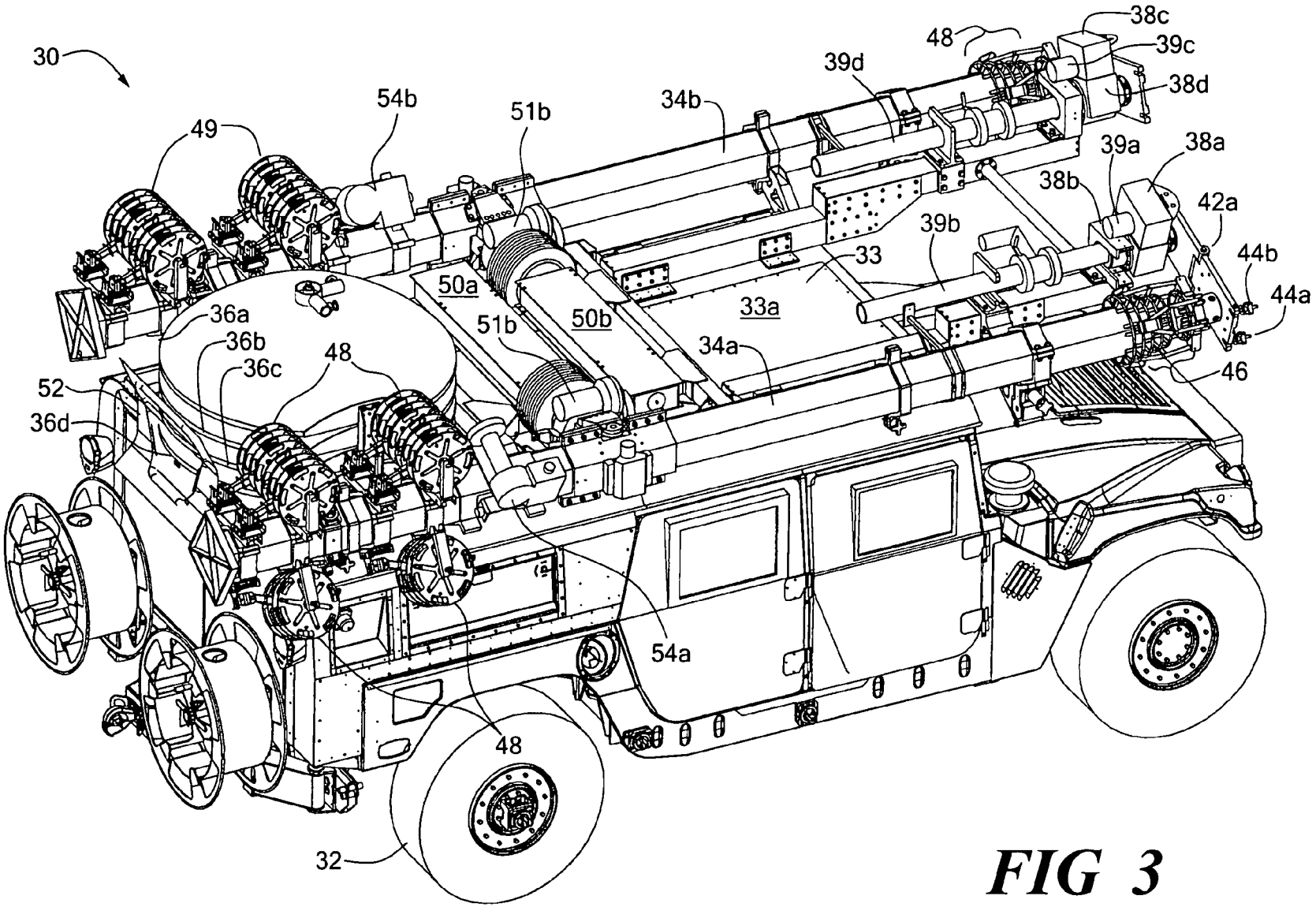
FIG. 3 is an isometric view of the light antenna mast group (LAMG) in accordance with the present invention, shown in a configuration suitable for transport.

Referring now to FIG. 3, in which like elements of FIG. 2 are shown having like reference designations, the LAMG 30 is shown in a configuration suitable for transport. The LAMG 30 includes the vehicle cap structure 33, including the antenna masts 34*a*, 34*b*, first antenna mast deployment mechanisms 50*a*, 50*b*, second antenna mast deployment mechanisms 51*a*, 51*b*, antenna mast extension mechanisms 54*a*, 54, an antenna storage system 52, and a plurality of guide wire spools collectively designated as 48, 49. The antenna rotators 38*a*, 38*b* are coupled to the antenna mast 34*a* and antenna rotators 38*c*, 38*d* are coupled to the antenna mast 34*b*.

During transport, the antenna masts 34*a*, 34*b* are stowed in a substantially horizontal position as shown. The rotators 38*a*, 38*b* are coupled to the antenna mast 34*a* with a hinge 42*a*. Similarly, the rotators 38*d*, 38*d* are coupled to the antenna mast 34*b* with a hinge 42*b* (not shown). The rotator 38*a* has a mounting portion 39*a* to which a first antenna 36*a* can be mounted, the rotator 38*b* has a mounting portion 39*b* to which a second antenna 36*b* can be mounted, the rotator 38*c* has a mounting portion 39*c* to which a third antenna 36*c* can be mounted, and the rotator 38*d* has a mounting portion 39*d* to which a fourth antenna 36*d* can be mounted. The mounting portions 39*b* and 39*d* are extended to allow the second and fourth antennas 38*b*, 38*d* to mount above the first and third antennas 38*a*, 38*c* respectively when vertically deployed. The antennas 36*a*–36*d* include respective antenna dishes, which in combination are referred to herein as the antennas 36*a*–36*d*.

With this particular arrangement, the rotators 34*a*–34*d* can remain coupled to the antenna masts 34*a*, 34*b* during transport. During transport the rotators 34*a*–34*d* are folded back as shown on respective hinges 42*a*, 42*b* so as to eliminate what would otherwise be a protrusion in front of the vehicle 32 by the mounting portions 39*b*, 39*d* if those mounting portions 39*b*, 39*d* were to protrude forward.

During transport, the antennas 36*a*–36*d*, each of which includes an antenna dish as shown and as described above, are stored apart from the antenna masts 34*a*, 34*b* in the antenna storage system 52. The antenna storage system is shown in greater detail in FIGS. 7A and 7B. Let it suffice here to say that the antenna storage system 52 has features and characteristics that facilitate placement of the antennas 36*a*–36*d* upon the antenna storage system 52 and removal of the antennas 36*a*–36*d* from the antenna storage system 52. With such features and characteristics, during deployment, the antennas 36*a*–36*d* can be rapidly removed from the antenna storage system 52.

During deployment, the rotators 38*a*–38*d* are pivoted on their respective hinges 42*a*, 42*b* to align with the antenna masts 34*a*, 34*b*. The hinges 42*a*, 42*b* can be locked into such alignment position with screw and knob structures 44*a*–44*d* (44*c*, 44*d* not shown). It will be appreciated that having the rotators 38*a*–38*d* affixed to the antenna shafts 34*a*, 34*b* allows a user to more rapidly deploy the LAMG 30 than if the user were required to perform a mounting step to attach the rotators 38*a*–38*d* to the antenna shafts 34*a*, 34*b*.

Each of the two antenna masts 34*a*, 34*b* includes a plurality of telescoping tubes (outer tube shown) of decreasing diameter, which can be deployed in a telescoping fashion to extend each of the antenna masts 34*a*, 34*b*. In one particular embodiment the telescoping tubes have a hexagonally shaped cross section. However, in other embodiments, antenna masts having other cross-sectional shapes can be used.

Each antenna mast 34*a*, 34*b* has a plurality of mounting rings, collectively designated as mounting rings 46, 48 respectively. Each of the plurality of mounting rings 46, 48 is coupled to the end of a telescoping tube. Each of the plurality of mounting rings 46, 48 can be used to attach a guide wire. The mounting rings 46, 48 are shown in greater detail in FIGS. 6A and 6B.

As described above, the LAMG 30 includes the plurality of guide wire spools, collectively designated as guide wire spools 48, 49, coupled to a respective antenna mast 34*a*, 34*b*. Each of the plurality of guide wire spools 48, 49 includes a guide wire (not shown) that can be coupled, upon deployment of the LAMG 30, to one of the plurality of mounting rings 46, 48 respectively. The guide wire spools 48, 49 are described in greater detail in conjunction with FIG. 8.

Also as described above, the LAMG 30 includes the first antenna mast deployment mechanisms 50*a*, 50*b*. The first antenna mast deployment mechanisms 50*a*, 50*b* allow a user to independently move each antenna mast 34*a*, 34*b* in a direction outward from the vehicle 32, while each of the antenna masts 34*a*, 34*b* remains substantially horizontal and substantially aligned with the central axis of the vehicle 32. Once the antenna masts 34*a*, 34*b* are moved outward from the vehicle 32 in a horizontal direction, the two second antenna mast deployment mechanisms 51*a*, 51*b* allow a user to independently rotate each respective antenna mast 34*a*, 34*b* to a substantially vertical orientation. The position of the first and second antenna mast deployment mechanisms 50*a*, 50*b*, 51*a*, 51*b* relative to the antenna masts 34*a*, 34*b* using a variety of factors, including, but not limited to, a position near a center of gravity of each respective antenna mast 34*a*, 34*b*. This selected position results in a relatively low torque required to erect the antenna masts 34*a*, 34*b* to a vertical orientation. The first and second antenna mast deployment mechanisms 50*a*, 50*b*, 51*a*, 51*b* are shown in greater detail in conjunction with FIG. 5.

Deployment of the LAMG 30 system is performed in a sequence of unordered steps, including but not limited to, configuring the rotators 38*a*–38*d* to be vertically aligned with the antenna masts 34*a*, 34*b* by way of the hinges

44*a*–44*d*, locking the rotators into the vertical alignment by way of the screw and knob structures 44*a*–44*d*, removing the antennas 36*a*–36*d* from the antenna storage system 52, attaching the antennas 36*a*–36*d* to the mounting portions 39*a*–39*d* respectively, moving the antenna masts 34*a*, 34*b* horizontally outward from the central axis of the vehicle 32 by means of the first antenna mast deployment mechanisms 50*a*, 50*b* respectively, rotating the antenna masts 34*a*, 34*b* to a substantially vertical orientation by means of the second antenna mast deployment mechanisms 51*a*, 51*b* respectively, and elevating the antenna masts by way of the antenna extension mechanisms 54*a*, 54*b* respectively. With the arrangement of the present system, the deployment steps can be rapidly performed.

At any point of the above process, the user can optionally attach one or more of the guide wires (not shown), contained in and pulled from the plurality of guide wire spools 48, 49 to a respective one of the plurality of mounting rings 46, 48. The guide wire spools 48, 49 remain coupled to the antenna masts 34*a*, 34*b* until the antenna masts 34*a*, 34*b* are vertically extended to operational height. The guide wire spools 48, 49 provide a spring tension to the guide wires. Therefore, the guide wires pay out without tangling as the antenna masts are vertically extended to operational height. Thereafter, the user detaches the used guide wires spools 38, 39 from the antenna masts 34*a*, 34*b* and couples the guide wires spools 38, 39 to stakes (not shown) implanted into the ground. The guide wires spools 38, 39 can be locked to restrict further payout of the guide wires from the guide wire spools 38, 39.

While the vehicle 32 is shown to be an HMMWV, it will be appreciated that in other embodiments, the vehicle 32 can be another type of vehicle, wherein the vehicle is selected to be capable of supporting the weight and functions of the vehicle cap structure 33.

While two antenna masts 34*a*, 34*b* are shown, it will be understood that the invention applies equally well to fewer than two or more than two antenna masts. Also, while particular features of the invention, for example the antenna storage system 52, are shown to be at particular locations on the vehicle 32, it will be understood that other positional arrangements are within the scope of this invention.

Figure 4:
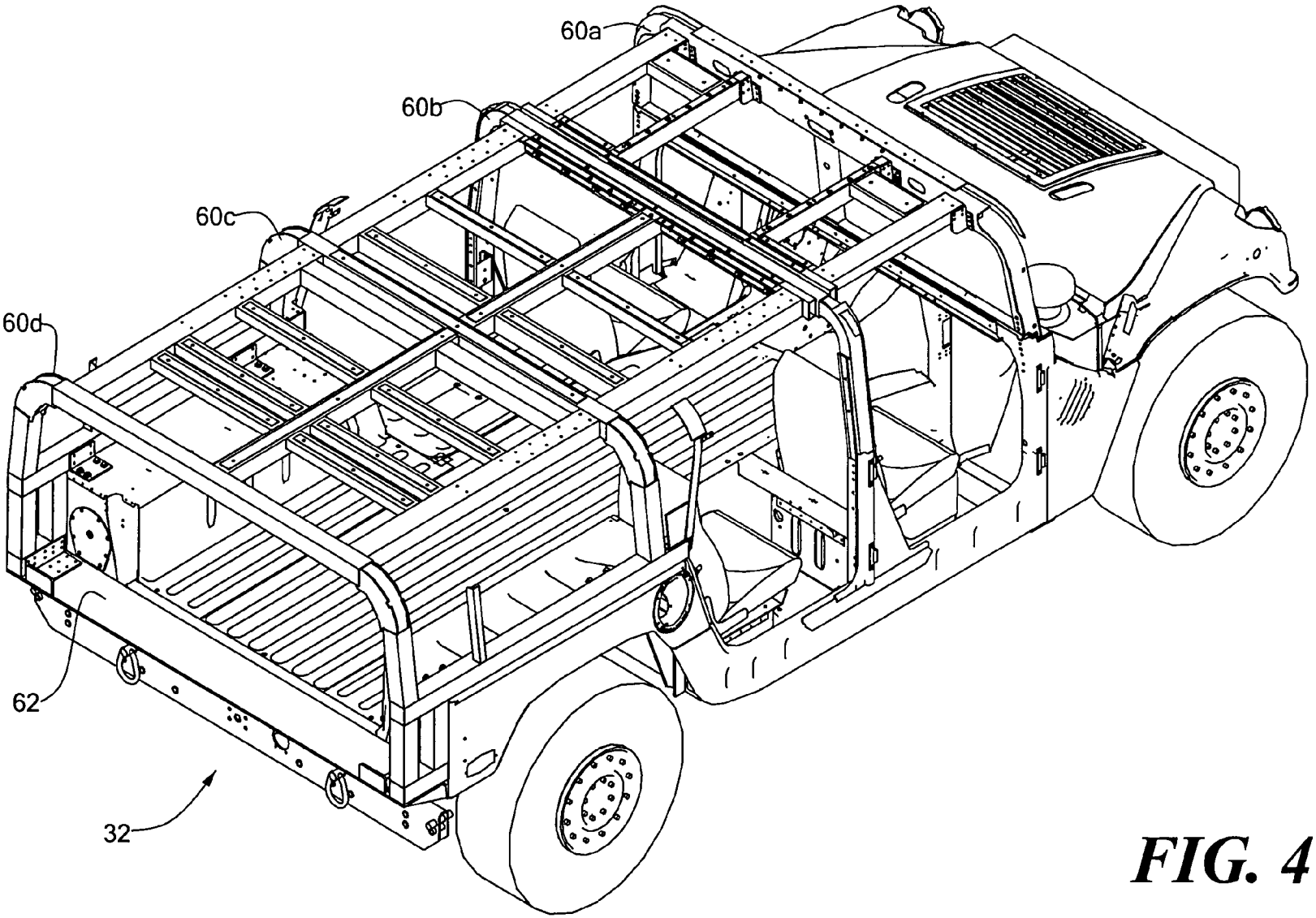
FIG. 4 is an isometric view of structural elements of a modified high mobility multipurpose wheeled vehicle (HMMWV) used as part of the LAMG.

Referring now to FIG. 4, in which like elements of FIGS. 2 and 3 are shown having like reference designations, the vehicle 32, here shown to be an HMMWV 32, includes first, second, third, and fourth support frames 60*a*–60*d* respectively. The fourth support frame 60*d* is coupled to a cross member 62 associated with an isolated frame of the vehicle 32. The first support frame 60*a*, the second support frame 60*b*, and the third support frame 60*c* will be recognized to be support frames associated with a conventional HMMWV vehicle. However, the fourth support frame 60*d*, in accordance with the present invention, provides additional structure that allows the vehicle cap structure 33 (FIG. 3) to mount to the vehicle 32 without damage to the vehicle 32 and without damage to the vehicle cap structure 33. The fourth support frame 60*d* also provides additional structure that allows the vehicle 32 to provide a stable platform for the antenna masts 34*a*, 34*b* when vertically deployed.

Figure 5:
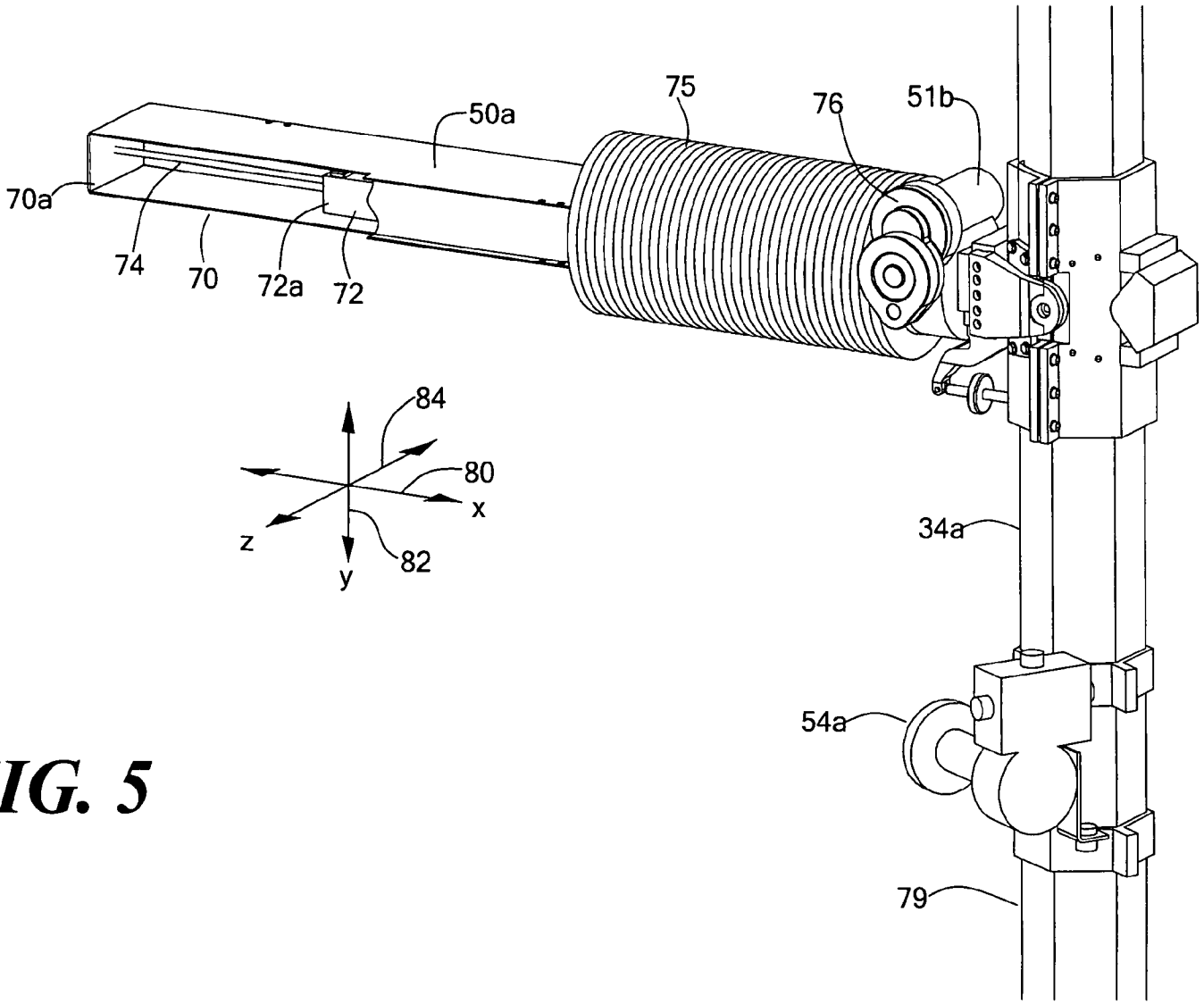
FIG. 5 is an isometric cutaway view showing an antenna mast deployment mechanism used as part of the LAMG.

Referring now to FIG. 5, in which like elements of FIGS. 2–4 are shown having like reference designations, the first antenna mast deployment mechanism 50*a* includes an outer slide rail 70 having and end 70*a* and an inner slide rail 72 having an end 72*a*. The inner slide rail 72 can move substantially linearly in an x-direction 80 relative to the outer slide rail 70. A screw rod 74 is coupled between the end 72*a* of the inner slide rail 72 and the end 70*a* of the outer slide rail 70. The inner slide rail 72 is internally threaded to accept the screw rod 74. The end 70*a* of the outer slide rail is coupled to the screw rod 74 in a way that allows the screw rod 74 to turn, but not to move in any other direction. The antenna mast 34*a* is coupled to the inner slide rail.

The second antenna mast deployment mechanism 51*a* includes a gear reduction mechanism 76 coupled to the inner slide rail and to the antenna mast 34*a*. A bellows 75 surrounds a portion of the outer slide rail 70 and a portion of the inner slide rail 72.

In operation, a user, either with a crank or with a hand-held motor assembly (not shown), turns the screw rod 74 from and end of the screw rod 74 proximate the end 70*a* of the outer slide rail 70. Being internally threaded, as described above, the inner slide rail 72 moves in an x-direction 80 in response to the user turning the screw rod 74. Therefore, when the user turns the screw rod 74, the antenna mast 34*a* moves substantially linearly in the x-direction 80, which is perpendicular to the central axis of the vehicle 32 (FIG. 3). The screw rod 74 provides a mechanical advantage to the user so that the deployment of the antenna mast in the x-direction 80 is achieved with relative ease.

The user similarly operates the gear reduction mechanism 76, either with a crank or with a hand-held motor assembly (not shown). When so operated, the gear reduction mechanism 76 allows the user to rotate the antenna mast 34*a* substantially about a plane described by a y-axis 82 and a z-axis 84, and therefore to rotate the antenna mast 34*a* to a substantially vertical orientation as shown. The gear reduction mechanism 76 provides a mechanical advantage to the user so that the deployment of the antenna mast 34*a* to a vertical orientation is achieved with relative ease.

The bellows 75 can extend and retract in the x-direction 80. Therefore, as the user deploys the antenna mast in the x-direction 80, the bellows 75 protects the inner slide rail 72 and the outer slide rail 70 from environmental contaminants.

Once the user deploys the antenna mast 34*a* in the x-direction 80 and rotates the antenna mast 34*a* to a substantially vertical orientation, the user can operate the antenna mast extension mechanism 54*a* to extend the antenna mast 34*a* upward in a telescoping fashion.

While the deployment in the x-direction 80 by turning the screw rod 74 is described to be performed either with a crank or with a hand-held motor assembly, in other embodiments, the deployment in the x-direction 80 is performed by a motor assembly integral to the first antenna mast deployment mechanism 50*a*.

Also, while the rotation of the antenna mast 34*a* by operating the gear reduction mechanism 78 is described to be performed either with a crank or with a hand-held motor assembly, in other embodiments, the rotation is performed by a motor assembly integral to the second antenna mast deployment mechanism 51*a*.

Figure 6A:
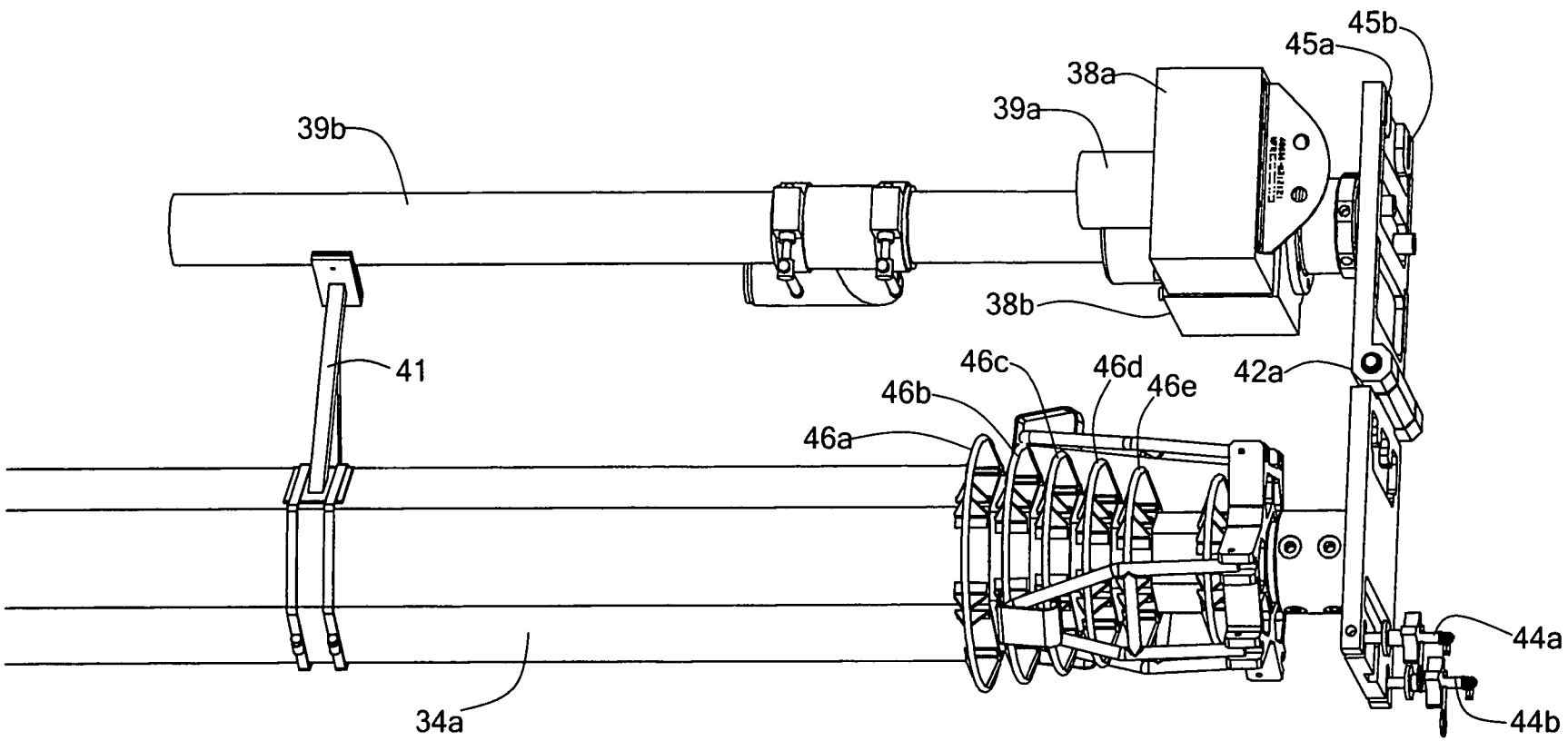
FIG. 6A is an isometric view showing an end of an antenna mast to which two rotators are attached, shown in an orientation suitable for transport.

Referring now to FIG. 6A, in which like elements of FIGS. 2–5 are shown having like reference designations, the antenna mast 34*a* has a plurality of extendible telescoping tubes (not shown), each of which has one of the mounting ring 46*a*–46*e* coupled to an end of each tube that will be uppermost when deployed to a vertical orientation. One or more guide wires can be attached to each of the mounting rings 46*a*–46*e* as described above.

The two rotators 38*a*, 38*b* are coupled to the antenna mast 34*a* with the hinge 42*a*. As described above in conjunction with FIG. 3, the rotator 38*a* has a mounting portion 39*a* to which a first antenna 36*a* can be mounted, and the rotator 38*b* has a mounting portion 39*b* to which a second antenna 36*b* can be mounted. The mounting portion 39*b* is longer to allow the second antenna 38*b* (FIG. 3) to mount above the first antenna 38*a* (FIG. 3) when vertically oriented.

The hinge 42*a* allows the rotators 38*a*, 38*b*, including the mounting portions 39*a*, 39*b*, to be folded back as shown during transport. Thus, during transport, the mounting portion 39*b* does not extend beyond the front of the vehicle 32 (FIG. 3).

A holding structure 41 retains the rotators 38*a*, 38*b*, holding the hinge 42*a* in an open position, as shown, during transport.

The screw and knob structures 44*a*, 44*b* are used in combination with the retention features 45*a*, 45*b* to hold the hinge in a closed position for vertical deployment of the antenna mast 34*a*. The closed position is shown in FIG. 6B.

While two rotators 38*a*, 38*b* are shown, it will be understood that, in other embodiments, the invention can equally well have more than two or fewer than two rotators.

Figure 6B:
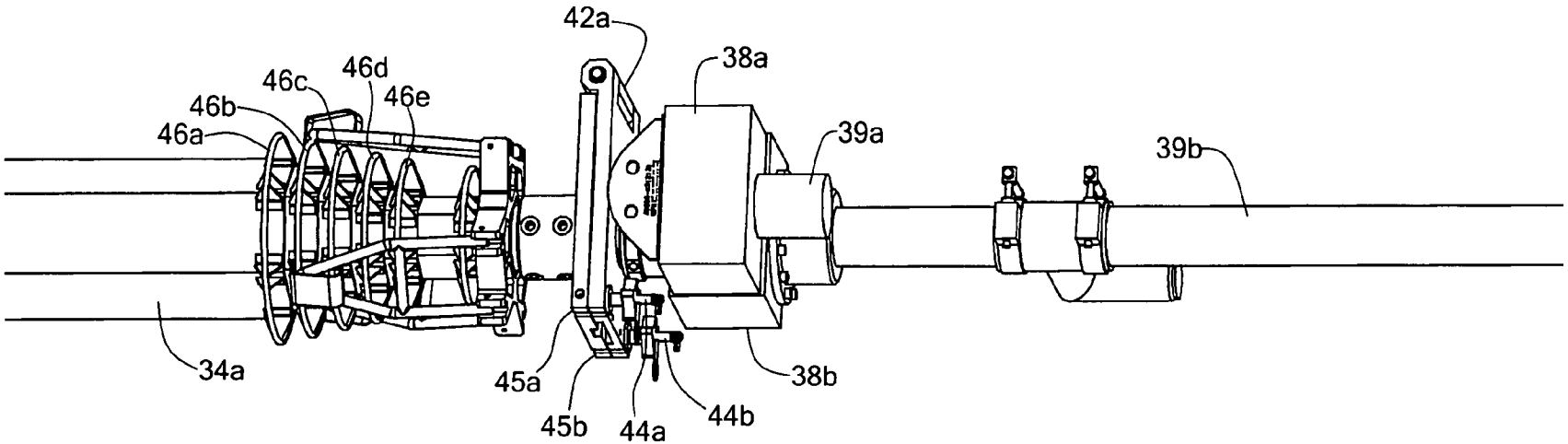
FIG. 6B is another isometric view showing the end of the antenna mast to which the two rotators are attached, shown in an orientation suitable for deployment.

Referring now to FIG. 6B, in which like elements of FIGS. 2–6A are shown having like reference designations, the screw and knob structures 44*a*, 44*b* are engaged with the retention features 45*a*, 45*b* and the screw and knob structures 44*a*, 44*b* are tightened. Therefore, the mounting structures 39*a*, 39*b* are locked into substantial vertical alignment with the antenna mast 34*a* in a position suitable for mounting the antennas 36*a*, 36*b* (FIG. 3) to the mounting structures 39*a*, 39*b* and for rotating the antenna mast 34*a* to a vertical position with the second antenna mast deployment mechanism 51*a* (FIGS. 3, 5).

Figure 7A:
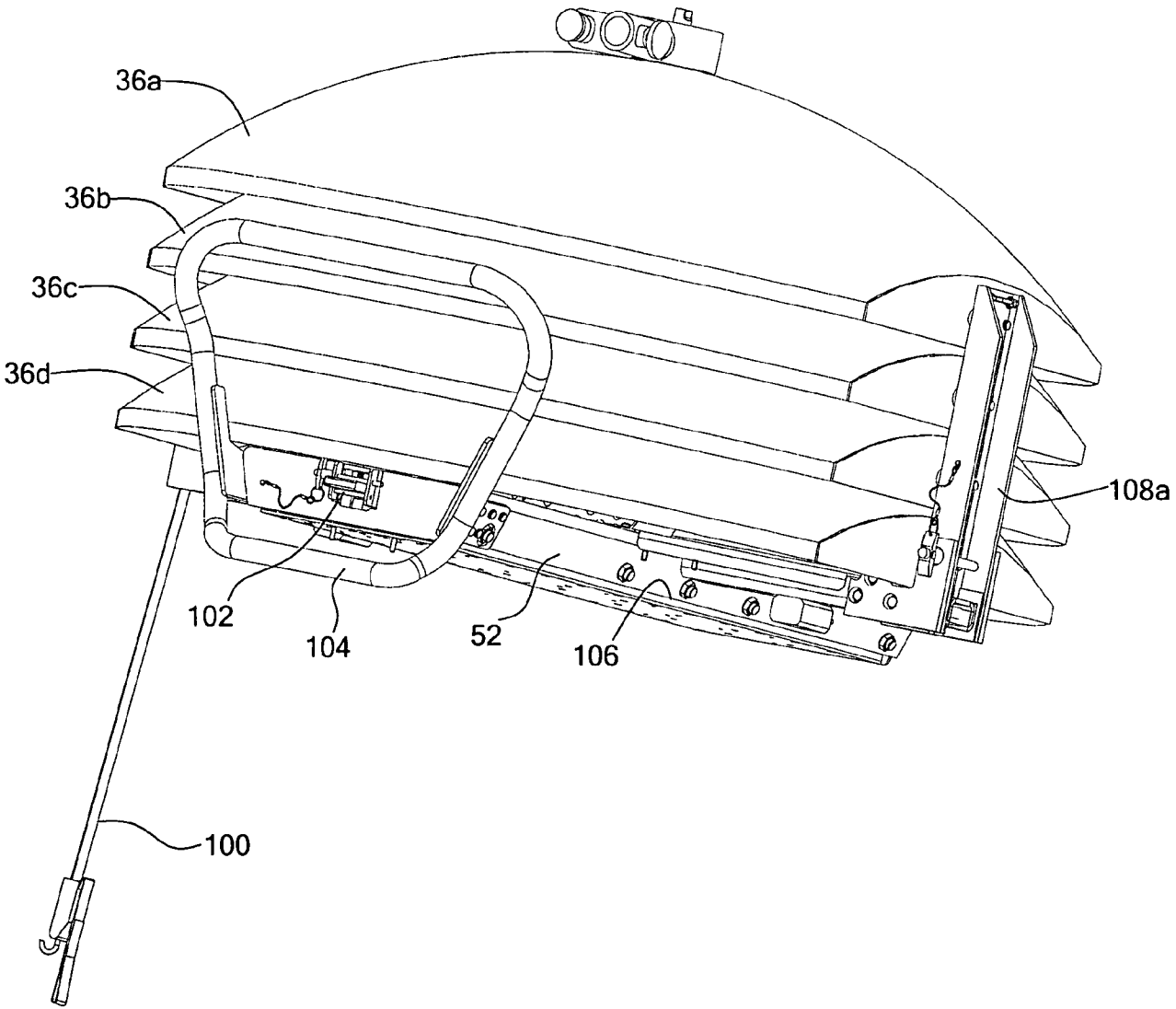
FIG. 7A is an isometric view showing an antenna storage system in accordance with the present invention.

Referring now to FIG. 7A, in which like elements of FIG. 3 are shown having like reference designations, the antenna storage system 52 includes a handle 104, which is pulled by a user in order to move the antenna storage system 52 to facilitate storing the antennas 36*a*–36*d* on the antenna storage system 52, and therefore, to facilitate removing the antennas 36*a*–36*d* from the antenna storage system 52. Movement of the antenna storage system 52 is described in conjunction with FIG. 7B.

The antenna storage system 52 includes a mounting tray 106 and side bars 108*a*, 108*b* (108*b* not shown), each adapted to hold the antennas 36*a*–36*d* in position during transport. The antenna storage system 52 also includes a locking mechanism 102 and a hold-down strap 100, each adapted to lock the antenna storage system 52 into a fixed position during transport and to retain the antennas 36*a*–36*d* in the antenna storage system 52.

Figure 7B:
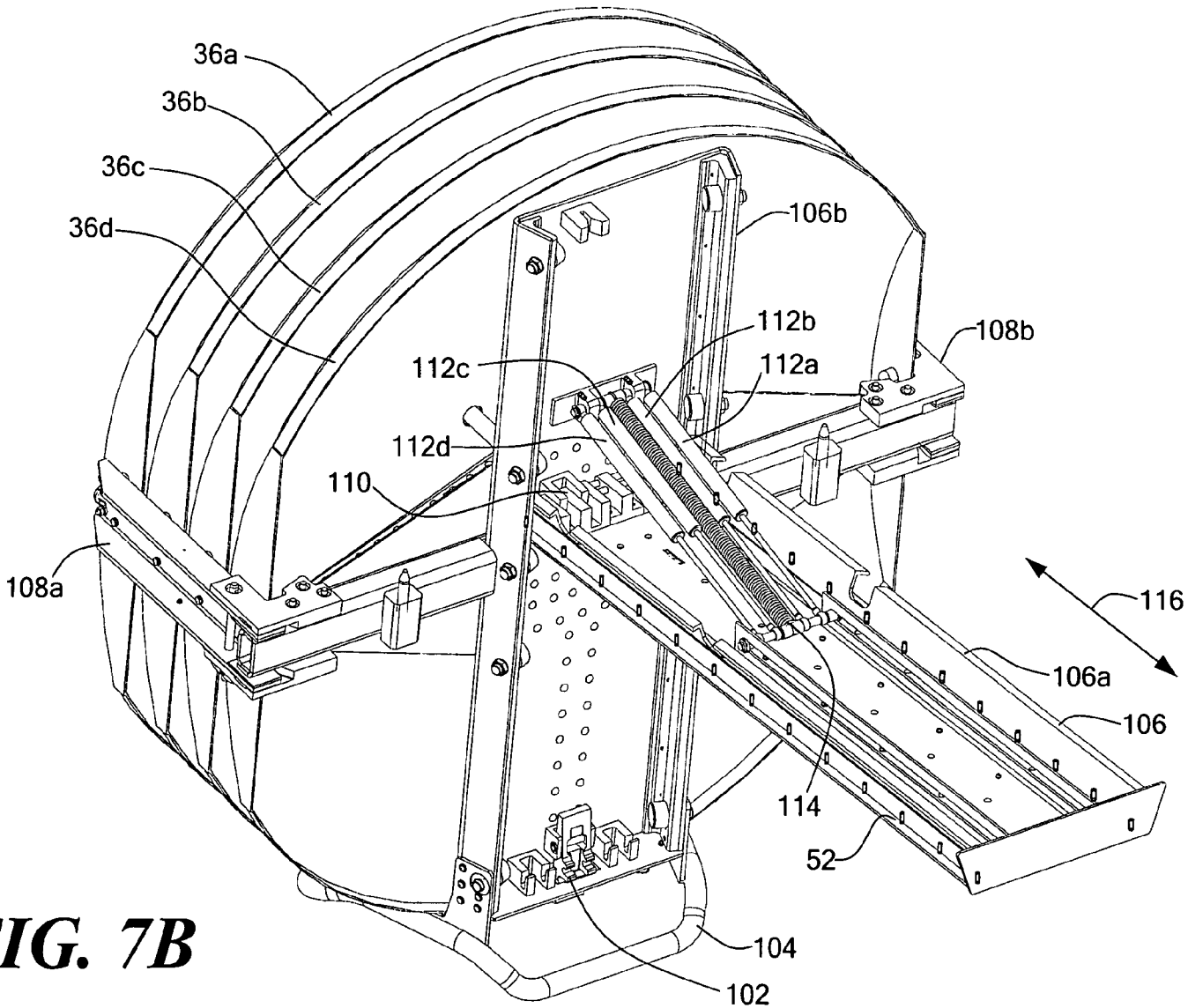
FIG. 7B is another isometric view showing the bottom of the antenna storage system of FIG. 7A.

Referring now to FIG. 7B, in which like elements of FIGS. 3 and 7A are shown having like reference designations, the antenna storage system 52 includes the mounting tray 106 having first and second mounting tray portions 106*a*, 106*b* moveably coupled to each other with a hinge 110. The first and second mounting tray portions 106*a*, 106*b* are adapted to both slide relative to each other in a direction 116 and to rotate about the hinge 10. The first mounting tray portion 106*a* is coupled to a surface 33*a* (FIG. 3) of the vehicle cap structure 33 (FIG. 3). The second mounting tray portion 106*b* can, therefore, move linearly along the surface 33*a* of the vehicle cap structure 33, and can pivot relative to the surface 33*a* of the vehicle cap structure 33.

The antenna storage system 52 also includes four dampers 112*a*–112*d* and a spring 114 adapted to control the pivoting of the second mounting tray portion 106*b* relative to the first mounting tray portion 106*a*. With this particular arrangement, a user can slide and pivot the second mounted tray portion 106*b*, relative to the first mounting tray portion 106*a*, and therefore relative to the vehicle cap structure 33 (FIG. 3).

While four dampers 112*a*–112*d* and one spring 114 are shown, it will be appreciated that in other embodiments more than four or fewer than four dampers and more than one spring can also be used. Also, while the antenna storage system 52 is shown to hold the four antennas 36*a*–36*d*, other embodiments of the antenna storage system can hold more than four or fewer than four antennas.

Figure 8:
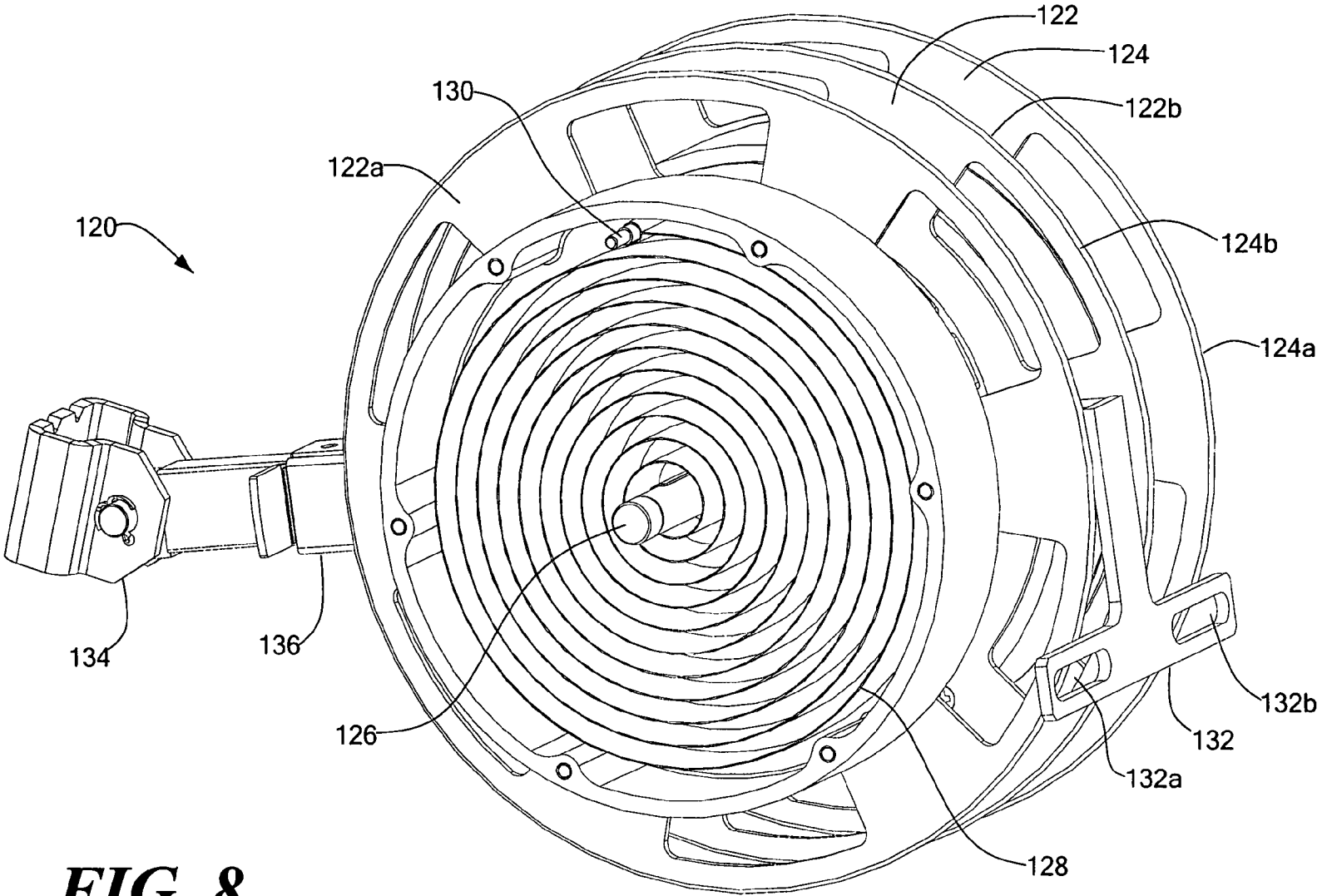
FIG. 8 is an isometric view showing a guide wire spool in accordance with the present invention.

Referring now to FIG. 8, a guide wire spool 120 can be the same as or similar to each of the plurality of guide wire spools 48, 49 shown in FIG. 3. The guide wire spool 120 includes a first guide wire drum 122 and a second guide wire drum 124, each adapted to spool a respective guide wire (not shown). The first guide wire drum 122 includes a first drum plate 122*a* and a second drum plate 122*b*. The second guide wire drum 124 includes a first drum plate 124*a* and a second drum plate 124*b*. The second drum plates 122*b*, 124*b* of the first and second guide wire drums 122, 124 respectively can be the same structure or can be separate structures. Each of the guide wire drums has a drum diameter (not shown) about which a guide wire (not shown) is spooled.

The guide wire spool 120 includes an axle 126 about which the first and second guide wire drums 122, 124 can turn. The guide wire spool 120 also includes a spring 128 coupled to a post 130 and to the axle 126. The spring provides increasing oppositional force as the first and second guide wire drums 122, 124 turn in a clockwise direction. Therefore, as a guide wire pays out from each of the guide wire drums 122, 124, the spring 128 maintains increasing tension on the guide wires.

Each of the guide wires passes though a guide plate 132, having first and second guide plate holes 132*a*, 132*b* though which a respective guide wire passes.

The guide wire spool 120 also includes a first mounting structure 134 coupled to one of the antenna masts 34*a*, 34*b* (FIG. 3) and a second mounting structure 136 coupled to and detachable from the first mounting structure 134. The second mounting structure 136 is adapted to allow a user to detach the guide wire spool 120 from one of the antenna mast 34*a*, 34*b* and to attach the guide wire spool 120 to a steak (not shown) in the ground adapted to receive the second mounting structure 136. With this particular arrangement, the guide wire spool 120 can be coupled to one of the antenna masts as the guide wire is paid out during vertical extension of the antenna masts 34*a*, 34*b* (FIG. 3). The spring 128 maintains tension upon the guide wires during the pay out. When the antenna masts 34*a*, 34*b* have been deployed to operational height, which can be any height less than the maximum height. The guide wire spools, of which the guide wire spool 120 is but one example, can be coupled to a stake in the ground.

The tension provided by the spring 128 is selected in accordance with a variety of factors, including, but not limited to, providing an ability to maintain sufficient tension to avoid tangles as the guide wire pays out during vertical extension of the antenna mast 34*a*, 34*b* (FIG. 3). The tension is also selected to be low enough so that a user can detach the cable spool 120 from the vehicle by way of the second mounting structure 136, and further pay out the guide wire as the cable spool 120 is coupled to a stake in the ground.

It should be recognized that once the guide wire spool is coupled to a stake in the ground, it would be advantageous to lock the first and second cable drums 122, 124 so that they can no longer turn, and so, no further guide wire can pay out. Any of a variety of known locking mechanisms can be used to provide this function. For example a locking pin or a brake mechanism can be used.

While one spring 128 is shown, in other embodiments, more than one spring can be used. Also, while a coil spring 128 is shown to have coils with increasing diameter wound in a plane perpendicular to the axle 126, in other embodiments, other spring arrangements can be used. For example a coil spring having coils of substantially equal diameter can be placed about the axle 126. Also, while two cable drums 122, 124 are shown to be coupled together, in other embodiments fewer than two or more than two cable drums can be provided with this invention.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims. All references cited herein are hereby incorporated herein by reference in their entirety.

What is claimed is:

1. An antenna apparatus, comprising:

a support frame adapted to couple to a rear end of a vehicle, wherein the vehicle is a motorized vehicle; and a vehicle cap structure coupled to the support frame, wherein the vehicle cap structure is adapted to cover a substantial portion of the vehicle, and wherein the vehicle cap structure includes:

at least one antenna mast coupled to the vehicle cap structure;

a first antenna mast deployment mechanism coupled to the at least one antenna mast and adapted to linearly move the at least one antenna mast in a direction substantially parallel to a major axis of the vehicle; and a second antenna mast deployment mechanism coupled to the at least one antenna mast and adapted to rotate the at least one antenna mast to a substantially vertical orientation.

2. The antenna apparatus of claim 1, wherein the support frame and the vehicle cap structure are adapted to couple to a vehicle weighing less than fifteen thousand pounds.

3. The apparatus of claim 1, wherein the vehicle cap structure is adapted to deploy the at least one antenna mast to a vertical height of at least eighty-four feet.

4. The antenna apparatus of claim 1, wherein the support fame and the vehicle cap structure frame adapted to couple to a high mobility multipurpose wheeled vehicle, HMMWV.

5. The antenna apparatus of claim 4, wherein the support frame is adapted to couple to a rear cross beam of an isolated frame associated with the HMMWV.

6. The antenna apparatus of claim 1, wherein the at least one antenna mast is capable of carrying a head load of at least two hundred fifty pounds when deployed to a height of at least eighty-four feet.

7. The antenna apparatus of claim 1, wherein the at least one antenna mast is capable of carrying a head load of at least two hundred fifty pounds iii winds greater than ninety-six miles per hour when deployed to at least eighty-four feet.

8. The antenna apparatus of claim 1, wherein the at least one antenna mast is tubular and has a maximum cross-sectional dimension greater than one hundred seventy millimeters.

9. The antenna apparatus of claim 1, wherein the at least one antenna at is comprised of telescoping tubes.

10. The antenna apparatus of claim 1, wherein the first antenna mast deployment mechanism includes:

an outer slide rail;

an inner slide rail coupled to the at least one antenna mast and disposed with the outer slide rail and in moveable contact with the outer slide rail; and a screw rod coupled to the inner and the outer slide rails and adapted to move the inner slide rail relative to the outer slide rail when turned.

11. The antenna apparatus of claim 1, wherein the second antenna mast deployment mechanism includes a reduction gear assembly.

12. The antenna apparatus of claim 1, wherein the vehicle cap structure further includes at least two antenna rotators coupled to the at least one antenna mast.

13. The antenna apparatus of claim 12, wherein the at least two antenna rotators are coupled to the at least one antenna mast with a hinge.

14. The antenna apparatus of claim 1, wherein the vehicle cap structure further includes at least two antennas removeably coupled to the at least one antenna mast, each of the at least two antennas including an antenna dish, each of the at least two antennas capable of being removed from the at least one antenna mast and stowed on the vehicle apart from the at least one antenna mast.

15. The antenna apparatus of claim 14, wherein the vehicle cap structure further includes an antenna storage system coupled to the vehicle cap structure and adapted to hold the at least two antennas during transport of the vehicle, the antenna storage system adapted to slide and to pivot to facilitate access to the at least two antennas and to facilitate removal of the at least two antennas from the antenna storage system.

16. The antenna apparatus of claim 15, wherein the antenna storage system includes:

a mounting tray adapted to couple to the at least two antennas, the mounting tray having first and second mounting tray portions adapted to slide and pivot relative to each other;

at least one hinge coupled to the first and second mounting tray portions;

at least one spring coupled to the first and second mounting tray portions; and at least one damper coupled to the first and second mounting tray portions.

17. The antenna apparatus of claim 1, wherein the vehicle cap structure further includes:

at least one guide wire spool including a guide wire, the guide wire spool removeably coupled to the at least one antenna mast, the guide wire adapted to couple proximate to a telescoping joint associated with the at least one antenna mast; and a spring return mechanism coupled to the guide wire spool and adapted to tension the guide wire.

18. A vehicle, comprising:

a support frame coupled to a rear end of the vehicle, wherein the vehicle is a motorized vehicle; and a vehicle cap structure coupled to the support frame, wherein the vehicle cap structure provides a covering over a substantial portion of the vehicle, and wherein the vehicle cap structure includes:

at least one antenna mast coupled to the vehicle cap structure;

a first antenna mast deployment means coupled to the at least one antenna mast and adapted to linearly move the at least one antenna mast in a direction parallel to a major axis of the vehicle; and a second antenna mast deployment mechanism a coupled to the at least one antenna mast and adapted to rotate the at least one antenna mast to a substantially vertical orientation.

19. The vehicle of claim 18, wherein the vehicle weighs less an fifteen thousand pounds.

20. The vehicle of claim 18, wherein the vehicle cap structure is adapted to deploy the at least one antenna mast to a vertical height of at least eighty-four feet.

21. The vehicle of claim 18, wherein the vehicle includes a high mobility multipurpose wheeled vehicle, HMMWV.

22. The vehicle of claim 18, wherein the support frame is adapted to couple to a rear cross beam of an isolated frame associated with HMMWV.

23. The vehicle of claim 18, wherein the at least one antenna mast is capable of carrying a head load of at least two hundred fifty pounds when deployed to a height of at least eighty-four feet.

24. The vehicle of claim 18, wherein the at least one antenna mast is capable of carrying a head load of at least two hundred fifty pounds in winds greater than ninety-six miles per hour when deployed to at least eighty-four feet.

25. The vehicle of claim 18, wherein the at least one antenna mast is tubular and has a maximum cross-sectional dimension greater than one hundred seventy millimeters.

26. The vehicle of claim 18, wherein the at least one antenna mast is comprised of telescoping tubes.

27. The vehicle of claim 18, wherein the first antenna mast deployment mechanism includes:

an outer slide rail;

an inner slide rail coupled to the at least one antenna mast and disposed with the outer slide rail and in moveable contact with the outer slide rail; and a screw rod coupled to the inner and the outer slide rails and adapted to move the inner slide rail relative to the outer slide rail when turned.

28. The vehicle of claim 18, wherein the second antenna mast deployment mechanism includes a reduction gear assembly.

29. The vehicle of claim 18, wherein the vehicle, cap structure further includes at least two antenna rotators coupled to the at least one antenna mast.

30. The vehicle of claim 29, wherein the at least two antenna rotators are coupled to the at least one antenna mast with a hinge.

31. The vehicle of claim 18, wherein the vehicle cap structure further includes at least two antennas removeably coupled to the at least one antenna mast, each of the at least two antennas including an antenna dish, each of the at least two antennas capable of being removed from the at least one antenna mast and stowed on the vehicle apart from the at least one antenna mast.

32. The vehicle of claim 31, wherein the vehicle cap sure further includes an antenna storage system coupled to the vehicle cap structure and adapted to hold the at least two antennas during transport of the vehicle, the antenna storage system adapted to slide and to pivot to facilitate access to the at least two antennas and to facilitate removal of the at least two antennas from the antenna storage system.

33. The vehicle of claim 32, wherein the antenna storage system includes:

a mounting tray adapted to couple to the at least two antennas, the mounting tray having first and second mounting tray portions adapted to slide and pivot relative to each other;

at least one hinge coupled to the first and second mounting tray portions;

at least one spring coupled to the first and second mounting tray portions; and at least one damper coupled to the first and second mounting tray portions.

34. The vehicle of claim 18, wherein the vehicle cap structure further includes:

at least one guide wire spool including a guide wire, the guide wire spool removeably coupled to the at least one antenna mast, the guide wire adapted to couple proximate to a telescoping joint associated with the at least one antenna mast; and a spring return mechanism coupled to the guide wire spool and adapted to tension the guide wire.

* * * * *

UNITED STATES PATENT AND TRADEMARK OFFICE

CERTIFICATE OF CORRECTION

PATENT NO. : 7,000,357 B1
APPLICATION NO. : 10/426817
DATED : February 21, 2006
INVENTOR(S) : Stearns et al.

It is certified that error appears in the above-identified patent and that said Letters Patent is hereby corrected as shown below:

Column 4, line 27 delete “weighs more thirty-five” and replace with --weighs more than thirty-five--.

Column 5, lines 36-37 delete “mechanisms 54a, 54,” and replace with --mechanisms 54a, 54b,--.

Column 5, line 45 delete “the rotators 38d, 38d” and replace with --the rotators 38c, 38d--.

Column 6, lines 53-54 delete “antenna mast 34a, 34b” and replace with --antenna masts 34a, 34b--.

Column 7, line 63 delete “having and end 70a” and replace with --having an end 70a--.

Column 8, line 13 delete “from and end of” and replace with --from an end of--.

Column 8, lines 57-58 delete “mounting ring 46a-46c” and replace with --mounting rings 46a-46e--.

Column 9, line 53 delete “hinge 10.” and replace with --hinge 110.--.

Column 10, line 31 delete “though” and replace with --through--.

Column 10, lines 38-39 delete “antenna mast 34a, 34b” and replace with --antenna masts 34a, 34b--.

Column 10, lines 47-48 delete “than the maximum height. The” and replace with --then the maximum height, the--.

Column 10, line 55 delete “antenna mast 34a, 34b” and replace with --antenna masts 34a, 34b--.

Column 11, line 45 delete “fame and the vehicle cap structure frame adapted to” and replace with --frame and the vehicle cap structure are adapted to--.

UNITED STATES PATENT AND TRADEMARK OFFICE

CERTIFICATE OF CORRECTION

PATENT NO. : 7,000,357 B1
APPLICATION NO. : 10/426817
DATED : February 21, 2006
INVENTOR(S) : Stearns et al.

It is certified that error appears in the above-identified patent and that said Letters Patent is hereby corrected as shown below:

Column 11, line 56 delete “pounds iii winds” and replace with --pounds in winds--.

Column 11, line 64 delete “one antenna at is” and replace with --one antenna mast is--.

Column 13, lines 1-2 delete “mechanism a coupled” and replace with --mechanism coupled--.

Column 13, line 40 delete “the vehicle, cap” and replace with --the vehicle cap--.

Column 14, line 11 delete “vehicle cap sure” and replace with --vehicle cap structure--.

Signed and Sealed this

Eighth Day of January, 2008

JON W. DUDAS
*Director of the United States Patent and Trademark Office*